US005580608A

United States Patent [19]

Capoccia

[11] Patent Number: 5,580,608

[45] Date of Patent: Dec. 3, 1996

[54] METHOD OF IMPARTING KNOCK-DOWN PATTERN TO WET TOPPING COMPOUND WITH A SPLAYING TOOL

[76] Inventor: John S. Capoccia, 6124 Cheshire Rd., Galena, Ohio 43021

[21] Appl. No.: 341,751

[22] Filed: Nov. 18, 1994

[51] Int. Cl.[6] ..... B05D 5/00

[52] U.S. Cl. ..... 427/277; 15/235.4; 15/245; 15/245.1

[58] Field of Search ..... 15/235.4, 236.02, 15/245, 245.1; 427/277, 356

[56] References Cited

U.S. PATENT DOCUMENTS 3,069,713 12/1962 Obraske ..... 15/235.4
5,261,144 11/1993 Mitchell et al. ..... 15/235.4

*Primary Examiner*—Katherine Bareford
*Attorney, Agent, or Firm*—Mueller and Smith, LPA

[57] ABSTRACT

Tool for imparting a knocked-down pattern to a wet, textured topping compound applied to a surface, and method of using the same. The tool is formed as including a generally planar, elongate base member having a widthwise extent extending between a first and a second edge, and a lengthwise extent extending along a longitudinal axis from a first to a second end. A flexible blade is provided to extend lengthwise with the longitudinal axis of the base member intermediate the first and second end thereof. The blade has a widthwise extent extending between a proximal edge supported by the base member and a distal edge disposed outwardly from the first edge of the base member which defines with the distal edge of the blade an upper working surface for contact with the topping compound. For moving the blade across the surface, a handle is provided to extend between a mounting end receiving the second edge of the base member intermediate the first and second end thereof, and a control end potion disposed outwardly of the base member opposite the blade. The handle is configured for a generally parallel orientation with the surface disposing substantially the entire working surface of the blade in a contact adjacency with the surface effective when the control end is pulled across the surface to splay the topping compound into a generally consistent knock-down relief pattern.

10 Claims, 3 Drawing Sheets

METHOD OF IMPARTING KNOCK-DOWN PATTERN TO WET TOPPING COMPOUND WITH A SPLAYING TOOL

BACKGROUND OF THE INVENTION

The present invention relates to a tool and method of using the same for splaying a wet, textured topping compound applied to a surface, such as a ceiling or the like, to impart a knock-down relief or soft-texture pattern thereto.

The finishing of ceilings in newly constructed or remodeled residential or commercial buildings typically involves a stippling process which imparts a texture thereto in lieu of a smooth, plastered finish. In addition to improving the aesthetic appeal of the room, the application of a textured finish decreases the labor required to finish the ceiling as concealing minor surface imperfections.

During the construction of drywall-type ceilings, adjacent drywall sheets are hung on the ceiling joists in an abutting contact which forms discontinuous joints between the drywall sheets. Where a finished surface is desired, the joints are filled with plaster or a latex-based joint compound, and then covered with a paper tape for a more continuous seam. The seams are smoothed with a trowel or the like to give the appearance of a continuous ceiling surface.

Once the joint compound has dried, a finishing coat of a topping compound may be applied to give the ceiling the noted textured finish. The topping compound is applied wet onto the ceiling with a high nap roller. Before the compound is allowed to dry or set completely, a textured or stippled finish may be imparted thereto with a brush. The brush is brought into and out of adjacency with the ceiling such that the bristles of the brush are contacted with and withdrawn from the wet topping compound. The withdrawal of the bristles from contact with the topping compound imparts a textured pattern of peaks or asperities thereto. By repeating the described steps, a repetitive pattern may be effected across the entire surface of the ceiling.

To a large extent, the exact pattern imparted into the topping compound is determined by the length, angle and density of the bristle population of the brush, and by the viscosity of the topping compound. Stippling brushes and methods for using the same are more fully described in the present inventor's commonly owned co-pending applications U.S. Ser. No. 08/233,355, filed Apr. 26, 1994, now U.S. Pat. No. 5,378,419, and U.S. Ser. No. 07/947,772, filed Sep. 18, 1992, now U.S. Pat. No. 5,419,434, the disclosures of which are expressly incorporated herein by reference. Alternatively, a textured pattern may be imparted to the ceiling by applying the topping compound with a spray machine or the like.

Recently, aesthetic concerns and market preferences have dictated ceiling texture patterns wherein the peaks or asperities left in the topping compound by the stipple brush or the spray machine are splayed, smoothed, or otherwise knocked-down to effect a more flattened relief. To knock-down the surface peaks, a trowel, knife, or other blade is dragged across the stippled ceiling surface before the topping compound is dried or set. The contacting of the compound with the blade both flattens and widens the peaks to impart a smoother, more embossed or relief-like pattern into the ceiling surface. Such a pattern often is seen as more desirable than the rougher, stippled pattern left by the stippling brush.

Heretofore, the methods employed to effect the knocking-down of textured ceilings involved the use of relatively rigid blades or trowels formed of metal, fiberglass, or plastic. The use of such blades, however, has been known to produce inconsistent knock-down patterns in the ceiling surface. In particular, it has been observed that the blades leave edge lines in the topping compound, and are unable to accommodate for imperfections or curvatures in the ceiling surface. Moreover, such blades often remove rather than splay the topping compound, which removal both excessively smoothes the texture of the compound and trails material on the blade which then may be randomly spread across the ceiling surface.

As an alternative to the rigid blades or trowels typically employed, some drywall finishers have resorted to using weather stripping moldings which are designed to be mounted around the frames of garage doors. Such moldings involve a wood member into which is inserted a flexible rubber seal. The wood member is grasped by the finisher, and the rubber seal is dragged across the ceiling surface in an attempt to produce a consistent knock-down pattern. It has been observed, however, that the rubber seal often flaps or chatters during knock-down, creating waves of imperfections in the topping compound. The molding also is known to be rather flimsy and unwieldy, making efficient work difficult.

The inconsistent knock-down patterns produced with the tools and methods heretofore known are often less than desirable, and frequently are a source of customer complaint. Indeed, the removal of dried topping compound having inconsistent patterns is time consuming and generally represents an expense which must be borne by the drywall contractor. Thus, it is apparent that improvements in the knocking-down of ceiling textures would be well-received by the industry, and would represent an important advancement to the drywall finishing arts.

BROAD STATEMENT OF THE INVENTION

The present invention is addressed to a tool and method of using the same for splaying a wet, textured topping compound applied to a surface, such as a ceiling or the like, to impart a knock-down relief pattern thereto. In providing for a flexible blade having an upper working surface for disposal in a contact adjacency with the surface, the present invention is able to effect the splaying of the topping compound into a generally consistent knock-down relief pattern.

Advantages of the present invention include a tool which is effective to splay a wet, textured topping compound material for imparting a consistent knock-down relief pattern thereto without any substantial removal of the material from the surface. The blade of the tool is able to accommodate for inconsistencies or curvatures in the surface, and leaves substantially no edge lines or other imperfections in the topping compound. Additionally, the tool minimizes the trailing of any hardened material or other so-called "hitchhikers" on or behind the blade, which hitchhikers are known to cause serious imperfections in the finished surface. In this regard, the tool of the present invention also will be appreciated to find utility in the finishing or refinishing of walls or the like where a generally smooth finish coat is desired.

It is, therefore, a feature of the present invention to provide a tool for imparting a knocked-down pattern to a wet, textured topping compound applied to a surface, and a method of using the same. The tool is formed as including a generally planar, elongate base member having a widthwise extent extending between a first and a second edge, and a lengthwise extent extending along a longitudinal axis from a first to a second end. A flexible blade is provided to extend lengthwise with the longitudinal axis of the base member intermediate the first and second end thereof. The blade has a widthwise extent extending between a proximal edge supported by the base member and a distal edge disposed outwardly from the first edge of the base member which defines with the distal edge of the blade an upper working surface for contact with the topping compound. For moving the blade across the surface, a handle is provided to extend between a mounting end receiving the second edge of the base member intermediate the first and second end thereof, and a control end portion disposed outwardly of the base member opposite the blade. The handle is configured for a generally parallel orientation with the surface disposing substantially the entire working surface of the blade in a contact adjacency with the surface effective when the control end is pulled across the surface to splay the topping compound into a generally consistent knock-down relief pattern.

It is a further feature of the invention to provide a method for imparting a knocked-down pattern to a wet, textured topping compound applied to a surface. The method involves the provision of a tool formed as including a generally planar, elongate base member having a widthwise extent extending between a first and a second edge, and a lengthwise extent extending along a longitudinal axis from a first to a second end. A flexible blade is provided to extend lengthwise with the longitudinal axis of the base member intermediate the first and second end thereof. The blade has a widthwise extent extending between a proximal edge supported by the base member and a distal edge disposed outwardly from the first edge of the base member which defines with the distal edge of the blade an upper working surface for contact with the topping compound. A handle, configured for a generally parallel orientation with the surface, is provided to extend between a mounting end receiving the second edge of the base member intermediate the first and second end thereof, and a control end portion disposed outwardly of the base member opposite the blade. The blade of the tool is moved into adjacency with the topping compound, and the handle of the tool is disposed generally parallel with the surface to place substantially the entire working surface of the blade in a contact adjacency with the surface. The control end of the handle then is pulled across the surface to move the working surface of the blade in correspondence therewith effective to splay the topping compound into a generally consistent knock-down relief pattern.

It is yet a further feature of the invention to provide a method for finishing a topping compound applied to a surface. The method involves the provision of a tool formed as including a generally planar, elongate base member having a widthwise extent extending between a first and a second edge, and a lengthwise extent extending along a longitudinal axis from a first to a second end. A flexible blade is provided to extend lengthwise with the longitudinal axis of the base member intermediate the first and second end thereof. The blade has a widthwise extent extending between a proximal edge supported by the base member and a distal edge disposed outwardly from the first edge of the base member which defines with the distal edge of the blade an upper working surface for contact with the topping compound. A handle, configured for a generally parallel orientation with the surface, is provided to extend between a mounting end receiving the second edge of the base member intermediate the first and second end thereof, and a control end portion disposed outwardly of the base member opposite the blade. The blade of the tool is moved into adjacency with the topping compound, and the handle of the tool is disposed generally parallel with the surface to place substantially the entire working surface of the blade in a contact adjacency with the surface. The control end of the handle then is pulled across the surface to move the working surface of the blade in correspondence therewith effective to splay the topping compound into a generally smooth finish coat.

The invention, accordingly, comprises the apparatus and method possessing the construction, combination of elements, and arrangement of parts and steps which are exemplified in the following detailed description. Reference to that description and to the accompanying drawings should be had for a fuller understanding and appreciation of the nature and objects of the invention, although other objects may be obvious to those skilled in the art.

BRIEF DESCRIPTION OF THE DRAWINGS

For a fuller understanding of the nature and objects of the invention, reference should be had to the following detailed description taken in connection with the accompanying drawings wherein.

The drawings will be described further in connection with the following Detailed Description of the Invention.

DETAILED DESCRIPTION OF THE INVENTION

For illustrative purposes, the present invention is described in the discourse to follow in conjunction with the splaying of a wet, stippled-textured topping compound applied to a ceiling surface. However, it will be appreciated that the present invention exhibits features which makes its suitable for the splaying other surfaces such as walls or the like, and for use with other textured topping compounds such as those applied with spray machines.

Figure 1:
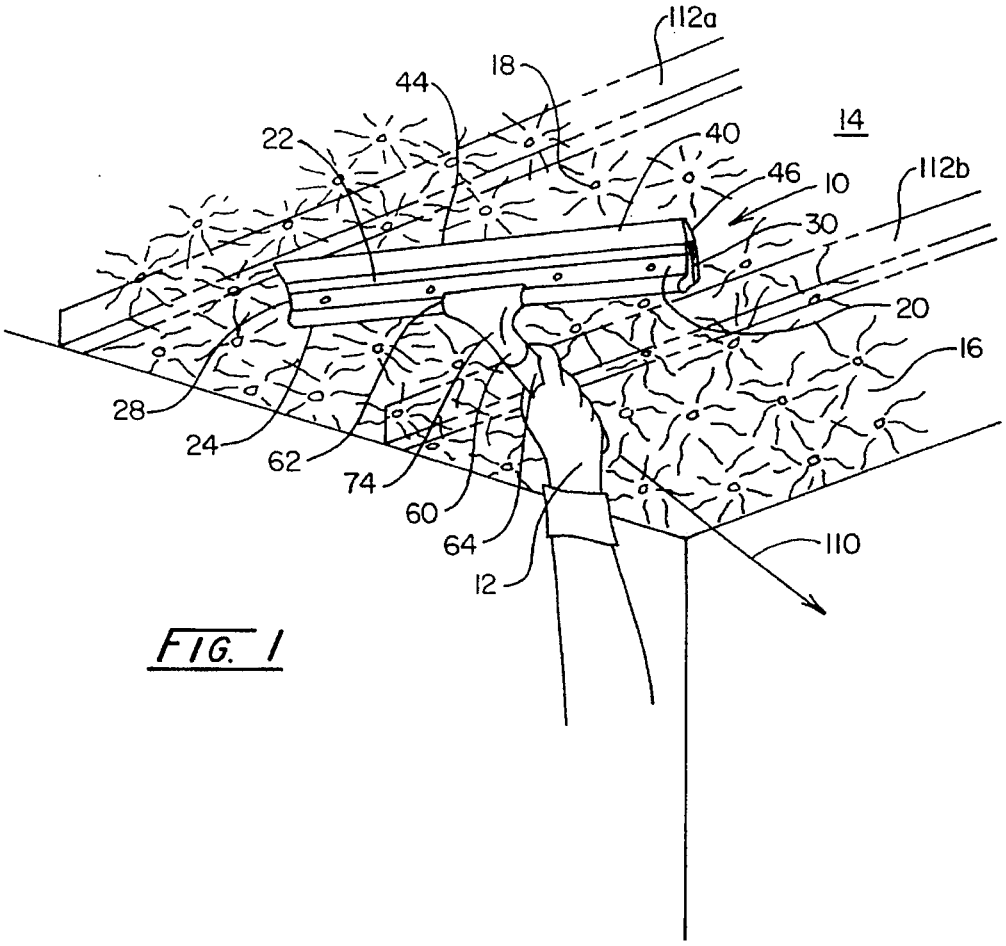
FIG. 1 is perspective view of a splaying tool according to the present invention as used to impart a knocked-down relief patterning to a ceiling surface having a wet, textured topping compound applied thereto.

Referring then to the figures wherein like reference numerals are used to designate like parts, a splaying tool according to the present invention is depicted in FIG. 1 at 10 to include a base member, 20, a flexible blade, 40, and at least one handle, 60. As is shown at 12, handle 60 is configured to be hand-graspable for the disposition of blade 40 in contact with the ceiling surface shown at 14. For illustrative purposes, ceiling surface 14 is shown as having applied thereto a thinned topping compound into which has been transferred a texture, a portion of which is referenced at 16, through repetitive contact with, for example, a stipple brush of the type further described in commonly owned co-pending applications U.S. Ser. No. 08/233,355, now U.S. Pat. No. 5,378,419 and U.S. Ser. No. 07/947,772, now U.S. Pat. No. 5,419,434, previously incorporated herein by reference. In this regard, the viscous properties of the topping compound forms patterns as is shown at 16 characterized by downwardly-extending peaks or asperities which are splayed, smoothed or otherwise flattened into a more aesthetically-pleasing relief or soft texture pattern, a portion of which is shown at 18, by the action of blade 40.

Figure 2:
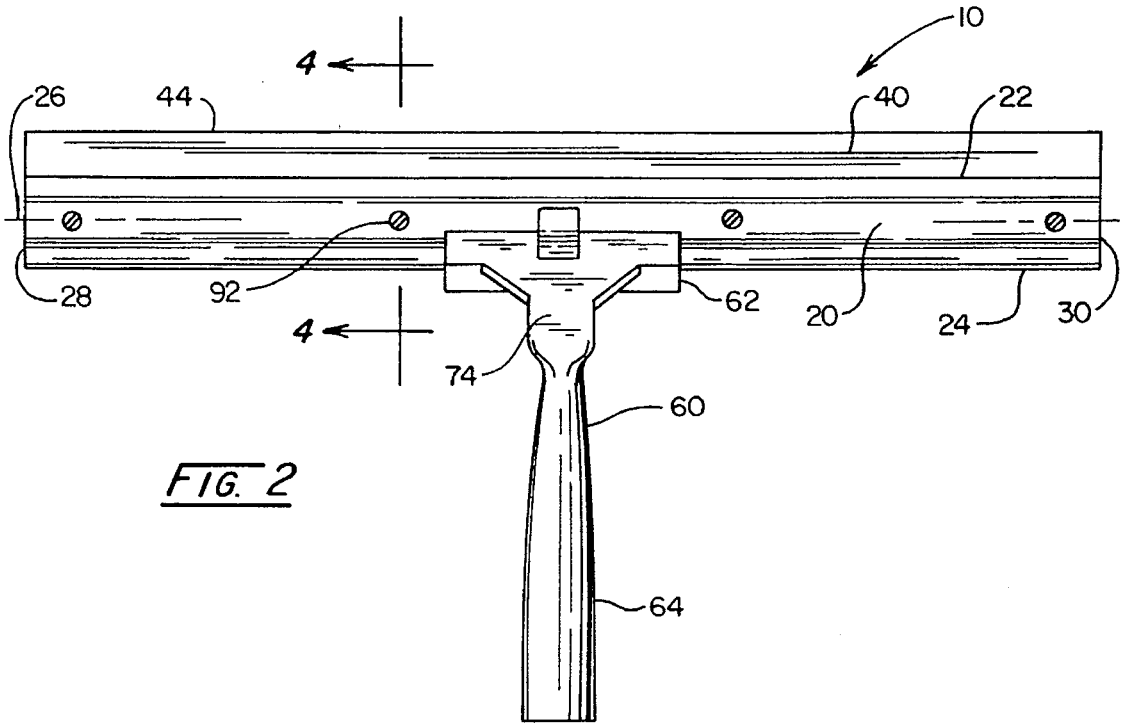
FIG. 2 is a plan view of the splaying tool of FIG. 1.

Looking next to FIGS. 2 and 3, the construction of tool 10 is further detailed in connection with a preferred embodiment thereof. From FIG. 1, it may be seen that base member 20 preferably is formed as a generally planar, elongate member having a widthwise extent extending between a first edge, 22, and a second edge, 24, and a lengthwise extent extending along a longitudinal axis, 26, from a first end, 28, to a second end, 30. As is represented by line 32, each end 20 and 30 of base member 20 alternatively may be angled at from about 30° to 60° with respect to second edge 24. Such angling facilitates the manipulation of tool 10 around or against crown or other moldings and the like without the blade chatter which otherwise would be caused by the contact of the edges of base member 20 therewith.

Flexible blade 40, in turn, is provided to extend lengthwise with longitudinal axis 26 of base member 20 intermediate first end 28 and second end 30 thereof. Blade 40 has a widthwise extent extending between a proximal edge, 42 (FIG. 3), supported by base member 20 and a distal edge, 44, disposed outwardly from first edge 22 of the base member. The first edge 22 of base member 20 defines with distal edge 44 of blade 40 an upper working surface, 46 (FIG. 3), for contact with the topping compound applied to the surface being finished.

Handle 60 is provided to extend between a mounting end, 62, receiving second edge 24 of base member 20 intermediate first end 28 and second end 30 thereof, and a hand-graspable control end portion, 64, disposed outwardly of base member 20 opposite blade 40. As is shown in FIG. 3 at 66, handle 60 control end portion 64 may be configured for threaded engagement with an extension member, 68, to facilitate the finishing of cathedral or vaulted ceilings or the like. Further, depending on the selected length of base member 20 and blade 40, two or more of handle 60 may be provided intermediate first and second end 28 and 30 of base 20. With a pair of spaced-apart handles provided, a two-handed manipulation of tool 10 may be envisaged.

Figure 5:
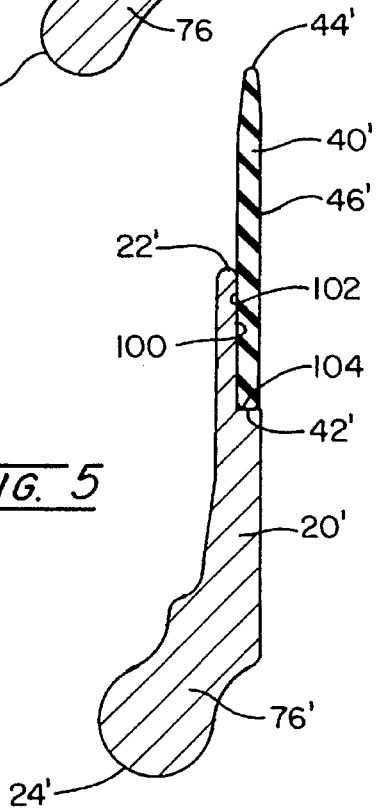
FIG. 5 is a cross-sectional view showing an alternative embodiment of the blade and base member of FIG. 4.
Figure 6:
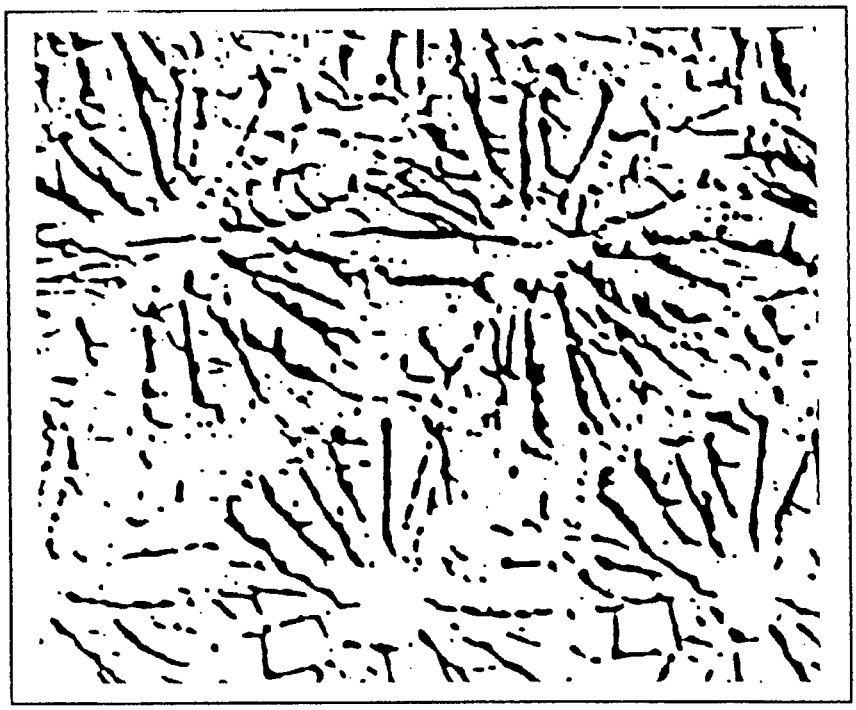
FIG. 6 is a graphically represented drawing of ceiling surface having a stippled-textured topping compound applied thereto.
Figure 7:
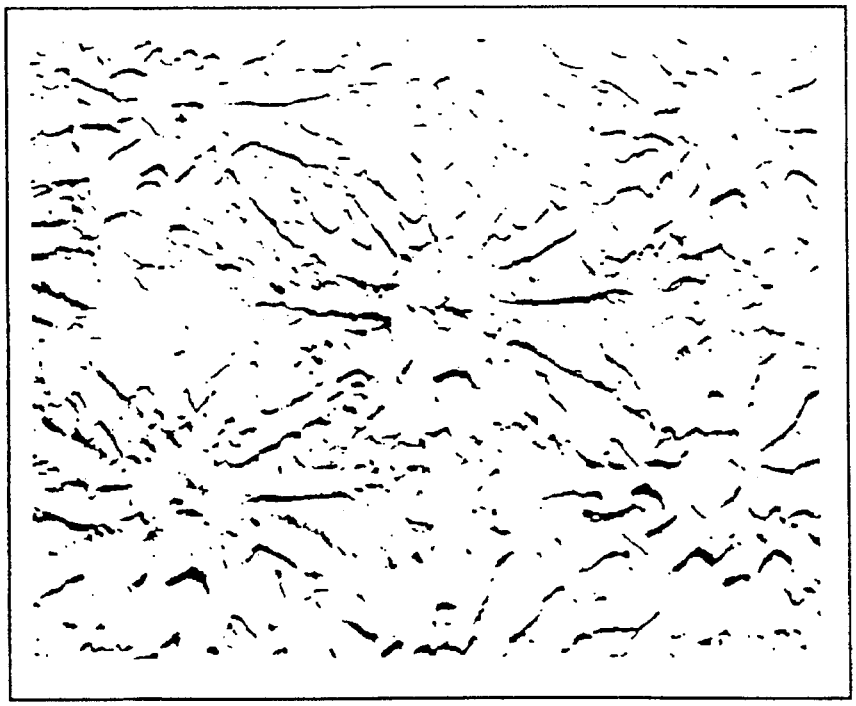
FIG. 7 is a graphically represented drawing of the ceiling surface of FIG. 6 with the textured topping compound thereof splayed into a knock-down relief pattern with the splaying tool of the present invention.

As may be appreciated with additional reference to FIG. 1, handle 60 is configured for a generally parallel orientation with surface 14 disposing substantially the entire working surface 46 of blade 40 in a contact adjacency with the surface. Such a contact has been observed to be effective, when control end 64 of handle 60 is pulled across surface 14, to splay the topping compound applied thereto into a generally consistent knock-down relief or soft texture pattern. In this regard, it will be appreciated that unlike the blade of a squeegee which is designed as having an edge for contact with a surface to remove liquid material therefrom, blade 40 of tool 10 of the present invention is configured for a surface area contact with the textured topping compound. In this way, the asperities of the topping compound may be splayed without substantially any removal of the compound from the surface to which it has been applied. This splaying, rather than removing, of topping compound imparts a discernible, aesthetically-pleasing, knock-down relief pattern to the surface being finished. Referring momentarily to FIGS. 5 and 6, a representative knock-down or soft texture relief pattern according to the present invention is graphically depicted at 72 in FIG. 7. For purposes of comparison, a stipple-textured pattern or unknocked-down pattern is graphically depicted at 70 in FIG. 6.

Figure 3:
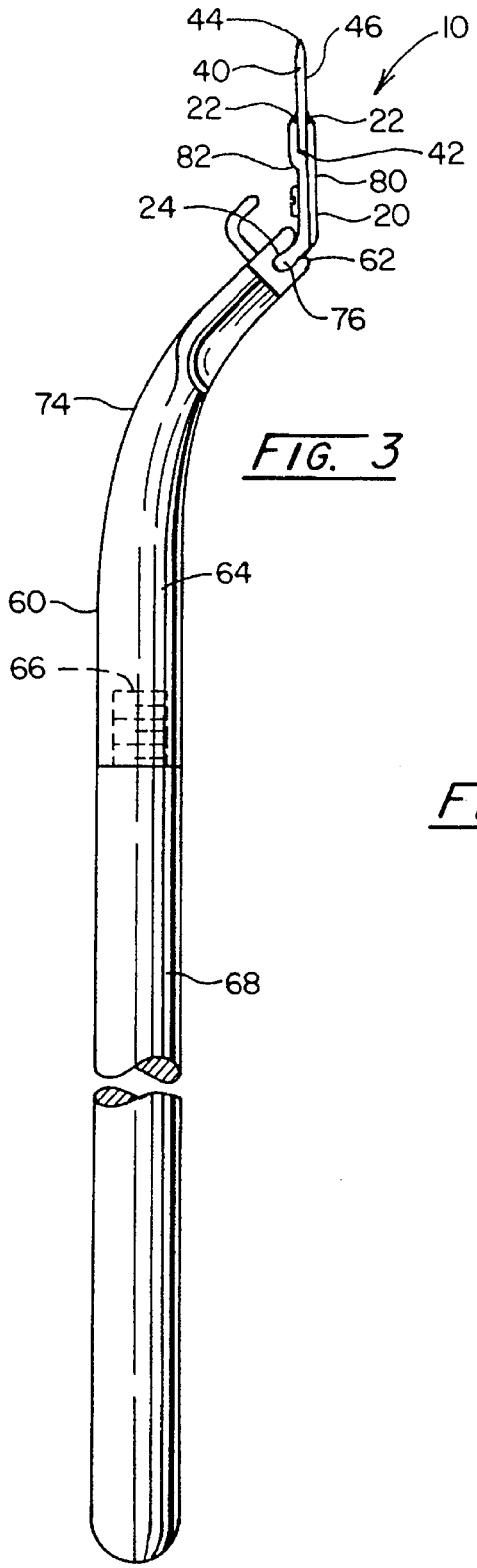
FIG. 3 is a side view of one the splaying tool of FIG. 2.

Referring now particularly to FIG. 3, for effecting the surface area contact between working surface 46 of blade 40 and ceiling surface 14 (FIG. 1), it is preferred that blade 40 is disposed to extend between proximal end 42 and distal end 44 thereof generally coplanarly with base member 20. Such disposition will be appreciated to facilitate a generally parallel confrontation as between working surface 46 and ceiling surface 14. Further, it is preferred that handle 60 is formed as having a neck portion, 74, configured to extend generally downwardly with respect to working surface 46 of blade 40 from mounting end 62 to control end 64. Second edge 24 of base member 20 additionally may be configured as having a tanged portion, 76, extending generally downwardly with respect to working surface 46. Mounting end 62 of handle 60 correspondingly may be configured to extend generally upwardly with respect to control end portion 64 to slidably receive tanged portion 76 in a removable engagement allowing for the replacement or interchange of base member 20. Configured as shown, neck portion 74 and tanged portion 76 space control end 64 of handle 60 a distance apart from surface 14 facilitating a generally parallel disposition to surface 14 placing work surface 46 of blade 40 into a surface area contact therewith.

Figure 4:
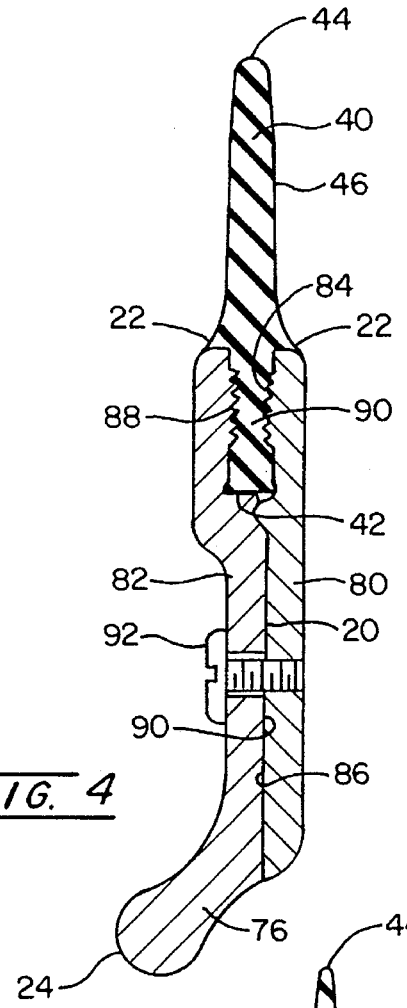
FIG. 4 is a cross-sectional view taken through line 4—4 of FIG. 2 showing the base member and blade of the splaying tool thereof in enhanced detail.

Looking next to FIG. 4, the construction of base member 20 and blade 40 of tool 10 is shown in enhanced detail. For making blade 40 replaceable to accommodate different surface textures of topping compounds, or for the repair of a damaged blade, it is preferred that base member 20 is formed as including upper and lower base components, 80 and 82, respectively. Upper base component 80 is provided to extend between first edge 22 and second edge 24 of base member 20 from a first recessed portion, 84, to a first faying surface, 86. Lower base component 82, in turn, is provided to extend between first edge 22 and second edge 24 of base member 20 from a second recessed portion, 88, to a second faying surface, 90, removably mated with first faying surface 84 of upper base component 80. With upper and lower base components 80 and 82 oriented as shown, the respective first and second recessed portions 84 and 88 thereof form an interior cavity, represented at 90, therebetween receiving proximal edge 42 of blade 40. Mechanical fasteners, one of which is shown at 92 as a sheet metal screw, may be received through lower base component 82 and into a threaded engagement with upper base component 80 to facilitate the removable mating thereof and access to blade 40. As is shown, it is preferred that blade 40 proximal edge 44 is formed as having a generally parabolic profile which is more effective than a sharp edge to splay rather than remove the topping compound material.

An alternative embodiment of base member 20 and blade 40 is shown in FIG. 5 as base member 20' and blade 40'. In such embodiment, base member 20' is of a single piece construction and is formed as having an upper support surface, 100, extending from first edge 22' intermediate second edge 24'. For supporting blade 40', first edge 22' of base member 20' defines with proximal edge 42' of blade 40 a lower support surface, 102, thereof disposed opposite working surface 46'. Upper support surface 100 of base member 20' receives lower support surface 102 of blade 40', which may be bonded thereto with a solvent-type adhesive or the like. To facilitate the receiving of blade 40' lower support surface 102 on base member 20' upper support surface 100, base member 20' may be configured as having a recessed portion, 104, extending from first edge 22' intermediate second edge 24'. In such configuration, the upper surface of recessed portion 104 forms the upper support surface 100 of base member 20' receiving the lower support surface 102 of blade 40'.

As to the materials of construction for tool 10 of the present invention, it is preferred that base member 20 be formed of a light-weight material such as a 6063-T6 aluminum or the like. In order to meet a variety of finishing applications, base member 20 may be of any length, but preferably is from about 12 inches to about 24 inches in overall lengthwise extent. Handle 60 may be formed of a material similar to that used for base member 20 or, alternatively, may be molded from a thermoplastic or other polymeric material. As to blade 40, it is preferred that it is formed of an elastomeric material such as a 70 durometer polyvinyl chloride (PVC) having a thickness of about 0.125 inch, a widthwise extent of about 1.250 inch or less, and a distal edge 44 radius of from about 0.03 to about 0.04 inch. Importantly, blade 40 is selected such that it is flexible sufficient to effect the aforementioned surface area contact with the surface being finished, but not so flexible as would cause flapping or chattering as it is pulled across the surface. Preferably, about 0.3 to about 0.5 inch of the widthwise extend of blade 40 is supported on base member 20, with from about 0.75 to about 1 inch thereof extending distally from base member 20 for forming working surface 46.

Returning to FIG. 1, in use, blade 40 of tool 10 is moved into adjacency with the topping compound applied to surface 14. With handle 60 disposed generally parallel to surface 14 placing working surface 46 of blade 40 in a contact adjacency therewith, control end 64 is pulled across surface 14, generally in the direction shown by arrow 110, to move working surface 46 of blade 40 in correspondence therewith. Such movement is effect is splay the wet, textured topping compound applied to surface 14 into the generally consistent knock-down relief pattern shown, for example, in FIG. 7.

Where, as is illustrated, surface 14 is formed of at least one drywall sheet or the like hung between at least a pair of spaced-apart, parallel support members, two of which are shown in phantom at 112*a* and 112*b*, it is preferred that working surface 46 of blade 40 is moved across surface 14 in a direction which, as is shown at 110, is generally perpendicular or transverse to members 112. As it is known that most drywall bows to some extent between its supporting studs or joists, it will be appreciated that moving tool 10 in a direction generally perpendicular to the parallel run of the support members maximizes the contact of working surface 46 of blade 40 with the ceiling or other surface being finished.

Additionally, it is expected that tool 10 of the present invention will find utility in the finishing or refinishing of walls or the like where a generally smooth finish coat is desired. Such finishing heretofore has been accomplished typically with standard trowels, the use of which required more than a modicum of skill to effect a smooth finish with an absence of trowel lines. However, when manipulated generally in accordance with the steps described in connection FIG. 1, tool 10 has been found useful in imparting a smooth finish coat to an untextured or unstippled topping or other finishing compound applied to a wall or other surface. Advantageously, the desired smooth finish may be obtained with a minimum amount of effort, and with little or no specialized training.

As it is anticipated that certain changes may be made in the present invention without departing from the precepts herein involved, it is intended that all matter contained in the foregoing description or shown in the accompanying drawings shall be interpreted as illustrative and not in a limiting sense.

What is claimed:

1. A method for imparting a knocked-down pattern to a wet, textured topping compound applied to a surface, said method comprising the steps of:

(a) providing a splaying tool comprising:

a generally planar, elongate base member having a widthwise extent extending between a first and a second edge, and a lengthwise extent extending along a longitudinal axis from a first to a second end;

a flexible blade extending lengthwise with the longitudinal axis of said base member intermediate the first and second end thereof, said blade having a widthwise extent extending between a proximal edge supported by said base member and a distal edge disposed outwardly from the first edge of said base member, the first edge of said base member defining with the distal edge of said blade an upper working surface of said blade for contact with the topping compound; and a handle extending between a mounting end receiving the second edge of said base member intermediate the first and second end thereof, and a control end portion disposed outwardly of said base member opposite said blade, said handle being configured for a generally parallel orientation with the surface;

(b) applying a topping compound to said surface:

(c) moving the blade of said tool into adjacency with the applied topping compound;

(d) disposing the handle of said tool generally parallel with the surface to place substantially all of said upper working surface of said blade in contact adjacency with the surface; and (e) pulling the control end of said handle across the surface to move said working surface of said blade in correspondence therewith effective to splay the topping compound into a generally consistent knock-down relief pattern.

2. The method of claim 1 wherein said blade of said tool is provided of an elastomeric material having a durometer of about 70.

3. The method of claim 1 wherein the proximal edge of said blade of said tool is provided has having a generally parabolic profile.

4. The method of claim 1 wherein:

the first edge of said base member of said tool is provided as defining with the proximal edge of said blade a lower support surface of said blade disposed opposite the working surface thereof, and as having an upper support surface extending from the first edge of said base member intermediate the second edge thereof, said upper support surface receiving the lower support surface of said blade.

5. The method of claim 4 wherein said base member of said tool is provided as having a recessed portion extending from the first edge of said base member intermediate the second edge thereof, said recessed portion having an upper surface forming said upper support surface of said base member.

6. The method of claim 1 wherein said base member of said tool is provided as comprising:

an upper base component extending between the first and second edge of said base member from a first recessed portion to a first faying surface; and a lower base component extending between the first and second edge of said base member from a second recessed portion to a second faying surface removably mated with the first faying surface of said upper base component, the first and second recessed portions forming an interior cavity therebetween receiving the proximal edge of said blade.

7. The method of claim 1 wherein:

said base member of said tool is provided as having a flanged portion extending to the second edge thereof generally downwardly with respect to the working surface of said blade; and said mounting end of said handle of said tool is provided to extend generally upwardly with respect to said control end portion for receiving said flanged portion of said base member.

8. The method of claim 1 wherein said blade of said tool is provided to extend between the proximal and distal ends thereof generally coplanarly with said base member.

9. The method of claim 8 wherein said handle of said tool is provided as having a neck portion extending generally downwardly with respect to said working surface of said blade from said mounting end of said handle to the control end portion thereof, said neck portion being configured to dispose the control end portion of said handle generally parallel to the plane of said blade and said base member.

10. The method of claim 1 wherein the surface is formed of at least one drywall sheet hung between at least a pair of spaced-apart, parallel support members, and said working surface of said blade is moved in step (d) across said surface in a direction generally perpendicular to the support members.

* * * * *